US006379495B1

(12) United States Patent
Giovannozzi Sermanni et al.

(10) Patent No.: US 6,379,495 B1
(45) Date of Patent: Apr. 30, 2002

(54) PROCESS FOR THE PRODUCTION OF CELLULOSE PAPER PULPS BY BIODELIGNIFICATION OF VEGETATIVE MASSES

(75) Inventors: Giovanni Giovannozzi Sermanni; Pier Luigi Cappellletto; Ruggero Baldo; Antonio Porri; Alessandro D'Annibale; Claudio Perani, all of Viterbo (IT)

(73) Assignees: Consiglio Nazionale Delle Ricerche, Rome; Universita' Studi Della Tuscia, Viterbo, both of (IT)

( * ) Notice: Subject to any disclaimer, the term of this patent is extended or adjusted under 35 U.S.C. 154(b) by 0 days.

(21) Appl. No.: 09/117,499

(22) PCT Filed: Jan. 31, 1997

(86) PCT No.: PCT/EP97/00424

§ 371 Date: Oct. 19, 1998

§ 102(e) Date: Oct. 19, 1998

(87) PCT Pub. No.: WO97/28306

PCT Pub. Date: Aug. 7, 1997

(30) Foreign Application Priority Data

Jan. 31, 1996 (IT) ..... MI96A0160

(51) Int. Cl.[7] ..... D21C 9/10; D21H 25/02

(52) U.S. Cl. ..... 162/57; 162/63; 162/65; 162/72; 162/96; 162/97; 162/98; 435/277; 435/278

(58) Field of Search ..... 162/72, 65, 55, 162/63, 57, 96, 97, 98, 60; 435/277, 278

(56) References Cited

U.S. PATENT DOCUMENTS 4,135,908 A * 1/1979 Widmer ..... 195/127
5,055,159 A 10/1991 Blanchette et al.

FOREIGN PATENT DOCUMENTS

| | | |
|---|---|---|
| CH | 667673 | 10/1988 |
| EP | 0060467 | 9/1982 |
| GB | 2265918 | 10/1993 |

* cited by examiner

*Primary Examiner*—Steve Alvo
(74) *Attorney, Agent, or Firm*—Collard & Roe, P.C.

(57) ABSTRACT

Process for the production of cellulose paper pulps from vegetable masses, comprising the steps of mixing and conditioning a vegetative mass suitable to form a culture medium with an inoculum constituted of edible ligninolythic mushrooms, such as *Lentinus edodes,* Pleurotis Peryngii, *Psajor-caju,* and the like; extracting the so-obtained enzyme and adding it to the vegetative material for the production of paper pulp, mainly constituted of cultivated annual plants such as kenaf, hemp, flax, cotton and various stems and/or agricultural-industrial residues, such as cereal straws, maize stalks, and the like; conditioning and causing the mass to react; and lastly washing the mass after the biological attack, obtaining in this way a cellulose pulp to be submitted to possible mild final cooking and bleaching treatment. Apparatus for the realiztion of the process, and cellulose pulps obtained by biodelignification of cultivated annual plants and/or agricultural-industrial residues.

8 Claims, 2 Drawing Sheets

PROCESS FOR THE PRODUCTION OF CELLULOSE PAPER PULPS BY BIODELIGNIFICATION OF VEGETATIVE MASSES

CROSS REFERENCE TO RELATED APPLICATIONS

Applicants claim priority under 35 U.S.C. §119 of Italian Application No. MI96A000160 filed Jan. 31, 1996. Applicants also claim priority under 35 U.S.C. §120 of PCT/EP97/00424 filed Jan. 31, 1997. The international application under PCT article 21(2) was published in English.

1. Field of the Invention

The present invention relates to a process for the production of cellulose pulps starting from cultured vegetative biomasses (treespecies, textile plants, etc.), with special reference to kenaf (*Hibiscus cannabinus*) or residues from other agricultural-industrial productions such as cereal straws, maize stalks, and the like.

The present invention also relates to the apparatus suitable to realise said process, as well as the vegetative biomasses produced from kenaf and textile plants in general.

2. Prior Art

"Textile fibre plants" and more simply "textile plants", even though they belong to different botanical genuses and species, have a stem formed by two main fractions, quite distinct and easily separable from one another: external cortical fibres (bast fibres) which constitute the real textile part characterised by aggregates of long and flexible fibres with a high content of cellulose and a low content of lignin, and the internal part (core or wood), constituted by aggregates of very short and rigid fibres.

Cortical fibres have good general characteristics, while the fibres of the internal part, on the contrary, have poor characteristics.

The ratio between cortical fibres and fibres of the wood part is generally 1:2, and they can be separated from one another by means of mechanical systems.

Among the plants that belong to the "textile fibre" group, the most common are: kenaf, hemp, flax, cotton (for the stem part), jute, ramie, roselle (*Hibiscus sabdarifa*), etc.

Kenaf, in particular, is an annual plant of Asian origin, that grows quickly (3–4 months), needs no particular cultivation practises and can grow in poor soils and with relatively low rainfall. At present it is cultivated in many regions of the world for the utilisation of the cortical part for textile purposes (sacks, ropes, etc.). Given its high productivity (up to 20 t/ha of dry matter), in the last years several attempts have been made at utilising kenaf also as a potential source of raw material for paper making.

The production of cellulose pulp for the paper industry is a process that utilises mainly arboreal species from specialised cultivations. Wood, reduced to dimensions of about 30–40 mm and a thickness of about 5–7 mm, is treated at high temperature and pressure with suitable mixes of chemical reagents that selectively attack lignin and hemicellulose macromolecules, rendering them soluble. Pulps coming from this first treatment, commonly called "cooking", are called "raw pulps"; they still contain partly modified lignin and are more or less Havana-brown coloured.

Raw pulps may be directly used to produce papers for packing or other industrial uses. However, if pulps should be used for fine and very fine papers (culture-papers, white papers, writing and printing papers and the like), raw pulps must be submitted to further chemical-physical treatments suitable to eliminate almost entire lylignin molecules and coloured molecules in general; this second operation is commonly referred to as "bleaching".

For this process, rapid growth ligneous plants are mainly used, which, with the help of chemical substances (alkali or acids), in condition of high pressure and temperature, are selectively delignified to obtain pulps containing cellulose and other components of lignocellulose. These pulps are then submitted to mechanical and chemical-physical treatments, in order to complete the removal of lignin and hemicellulose residual components, and utilised thereafter for paper production. Such paper making processes are characterised by a high consumption of thermal and mechanical energy and as much high use of chemical reagents that are found, at the end of the process, in the fabrication waters mixed with the organic substances dissolved by cooking (refluents).

Refluents must be treated in satellite plants comparable, for size and complexity, to the same paper mills; because of the absolute need of treating refluents, running production units with a production power of less than 150,000 t/year is uneconomic and prevents a cellulose production in countries, such as Italy, that do not have large areas to be assigned to these productions.

The same is true for countries whose internal paper consumptions are lower than the aforesaid quantities, as are generally emergent countries.

Fabrication yields, expressed as pulp quantity obtained compared to the starting material, vary within a wide range that depends especially on the quantity of chemical reagents used, from a minimum amount of 40–45% for bleached chemical pulps used in the fabrication of fine and very fine papers, to about 90% for pulps produced utilising only mechanical energy (however, such pulps have poor resistance and durability and are used especially for newspapers).

An approximate classification of pulps, based on the intrinsic qualities of pulps and fabrication yields, may be the following:

| | |
|---|---|
| Bleached chemical pulps | 40–50% yield |
| Raw chemical pulps | 45–60% yield |
| Semi-chemical pulps | 70–75% yield |
| Semi-mechanical pulps | 75–85% yield |
| Mechanical and thermomechanical pulps | 85–93% yield |

Recently, many economic, ecological and market reasons have spurred an active interest for the setting up of new technologies for the production of cellulose pulps, which technologies, besides allowing to run small and little pollutant production units because of the use of lesser amounts of chemical products, may profitably use raw materials other than the traditional arboreal species, and in particular annual plants and vegetable residues coming from other agricultural-industrial workings. Among said technologies, the thermomechanical process used in the preparation of cellulose pulps is worth mentioning, as this process provides several non negligible advantages, among which the high yields and the production of effluents having a polluting charge markedly lower than that obtained by the use of conventional chemical processes.

In the beginning, the use of new technologies was on the colonisation of the material by fungi having a high lignolythic activity Ander, P., Eriksson, K. E. L., Svensk Papperstid. 78:641 (1975), but such approach was not applicable because of many drawbacks due to the high weight losses of the material, ascribable to mycelium metabolism, and especially to the length of the treatment period, which seemed incompatible with paper production cycles [Samuelsson, L. Mjoberg, .J., Hartler, N., Vallander, L. and Eriksson, K. E. L., Svensk Papperstid. 83:221 (1980); Eriksson, K. E., Vallander, L. Svensk Papperstid., 85(6):33 (1982), even though said processes seemed to have good results for energy saving Myers, G. C., Leatham, G. F., Wegner, T. H., TAPPI J. 71(5):105 (1988]) and improvement in strength characteristics of paper layers.

Such difficulties have oriented research towards the development of applications based on the use of enzymes suitable for lignocellulose degradation. Said enzymes are produced by organisms that can utilise lignocellulose residues, in particular fungi responsible for wood butt rot, or more generically wood saprophyte mycelia, of which some thousands of species are known. In particular, the discovery of an enzyme, lignin peroxidase, involved in lignin degradation, has polarised the attention of many people on the development of applications based on its utilisation [Arbeloa, M., de Leseleuc, J., Goma, G., Pommier, J. C., TAPPI J. 75(3):215 (1992)]. Afterwards, also these applications have been downsized by several evidences; in particular, the extreme fragility of this enzyme, the necessity of adding hydrogen peroxide to ensure working, and the necessity of utilising it in combination with other enzymes, such as xylanase and beta-kylosidase, to obtain substantial results [Viikari, L., Ranua, M., Kantelinen, A., Sundqvist, J., Linko, M. Proceed. 3rd Int. Symp. on Biotechnol. in the Pulp and Paper Ind., 67 (1986)].

SUMMARY OF THE INVENTION

An object of this invention is to provide a process for the production of cellulose paper pulps allowing to use as raw materials both the conventional raw materials—such as arboreal species—and annual plants especially cultivated, such as textile plants, kenaf and the like, and also waste material, such as cereal straws, maize stalks, and the like.

Another object of this invention is to realise a process for the production of paper pulps from vegetable biomasses, essentially by biodelignification, that is highly selective with regard to the attack of lignocellulose copolymers, that may be realised according to a continuous process, with high yields, that gives constant and reproducible results, and that allows a limited use of reagents and produces no toxic and/or heavily polluting substances and/or substances of difficult and expensive disposal.

These and still other objects and related advantages which will be clearly understood from the following description, are achieved by a process for the production of cellulose paper pulps from vegetative masses, which process, according to the present invention, comprises the following stages:

- sterilisation at a temperature higher than 120×C of a mass suitable to form the culture medium;
- mixing of said sterilised mass, inoculated with an inoculum in a dosed quantity, with heated and sterile water, in an amount such as to bring said inoculated mass to the wished temperature and concentration;
- conditioning and reaction under stirring of said inoculated mass in a controlled atmosphere of $CO_2$ and $O_2$ and in a sterile environment, at controlled temperature and pH, for a period comprised between 20 and 300 hours, with production of suitable enzyme mixes;
- elementarisation of the mass containing said enzyme mixes and soaking up of the same with an extraction fluid, such as water, with formation of a suspension;
- extraction of the enzymes present in said extraction fluid through pressing and backwashing of said suspension, obtaining an extract of enzymes, and separation of the exhausted solid resulting from said pressing;
- elementarisation, separation, cleaning and selection of vegetative materials for the production of said cellulose paper pulp, obtaining a vegetative mass and a vegetative waste material;
- compacting of said vegetative mass to eliminate the air contained in said mass and to reduce its volume;
- mixing of said compact mass with said enzyme extracts in dosed quantity and possibly with heated water, in order to obtain a vegetative mass with a solid content comprised between 10 and 50% by weight;
- conditioning and reaction under stirring of said vegetative mass, mixed with said enzymes in a controlled atmosphere of $CO_2$ and $O_2$, with controlled temperature and pH for a period comprised between 5 and 50 hours and subsequent washing with water, obtaining a washed cellulose paper pulp with a low content of residual modified lignin and a washing fluid containing the soluble substances originally contained in said vegetative material together with the substances solubilised by the biological attack;
- possible cooking and bleaching treatment of said washed cellulose pulp;
- purification and disposal of said washing fluid.

More particularly, said vegetative material for the production of cellulose paper pulp is constituted of annual cultivated plants, such as kenaf (*Hybiscus cannabinus*), hemp, flax, cotton, various stems and the like, and/or agricultural-industrial residues, such as cereal straws (wheat, barley, rye, rice), maize stalks, etc.

Advantageously, the inoculum is made of edible lignolythic mushrooms, such as *"Lentinus edodes", "Pleurotus eryngii", "Pleurotus sajor caju",* extracts thereof and/or liquid, semisolid or solid culture media thereof.

Different species of mushrooms such as: *Laetiporus sulphureus, Pleurotus ostreatus, Pleurotus sajor-caju, Pleurotus eringii, Coprinus stercorarius, Stropharia ferrii, Lentinus edodes, Trichoderma koningii, Trichotecium roseum,* Penicillium sp., etc., have been inoculated on wheat straw, maize stalks, stumps of Eucalyptus camaldulensis and kenaf stems.

Such mushrooms may also be grown in artificial conditions, either on solid media (solid state fermentation) or liquid media (submerged fermentation) in order to obtain the production of such exocellular enzymes [Giovannozzi-Sermanni, G.Porri, A. Chimicaoggi 3,15–19 (1989); Giovannozzi-Sermanni et al., AgroFoof Ind. HiTech 3(6): 39 (1992)].

In the optimum ratio between one another, such exoenzymes may be utilised for selective biodelignification. Generally, these enzymes are produced by selected fungus cultures, so that the activity of the enzymes produced by the same are as high as possible with regard to lignins and hemicelluloses and as low as possible with regard to celluloses.

In the solid state, they may be obtained by means of an especially designed batch bioreactor to obtain controlled growth conditions, and mix of exaenzymes in a rigorously reproducible manner [Giovannozzi-Sermanni et al., Chimicaoggi 3:55 (1987)]. The preparation of the enzyme cocktail may be carried out using the already mentioned solid state fermentation technique; among other things, this technique utilizes as fungus culture the medium the vegetable wastes derived from the dry cleaning of the vegetative material intended for the fabrication of cellulose pulps or other vegetative waste biomass.

As mentioned, the delignification process subject matter of this invention satisfies some basic requirements, such as: degradation uniformity of the lignocellulose biomass, process velocity, result reproducibility, biodegradation efficiency, mycelium growth optimisation, attack selectivity of lignocellulose copolymers, absence of toxic compound of fungus-origin, such as aflatoxins, in refluents, possibility of carrying on a continuous production of the enzyme mix, possibility of carrying on the biodelignification process utilising a continuous enzymatic mixes process.

DETAILED DESCRIPTION OF THE EMBODIMENT

Figure 1:
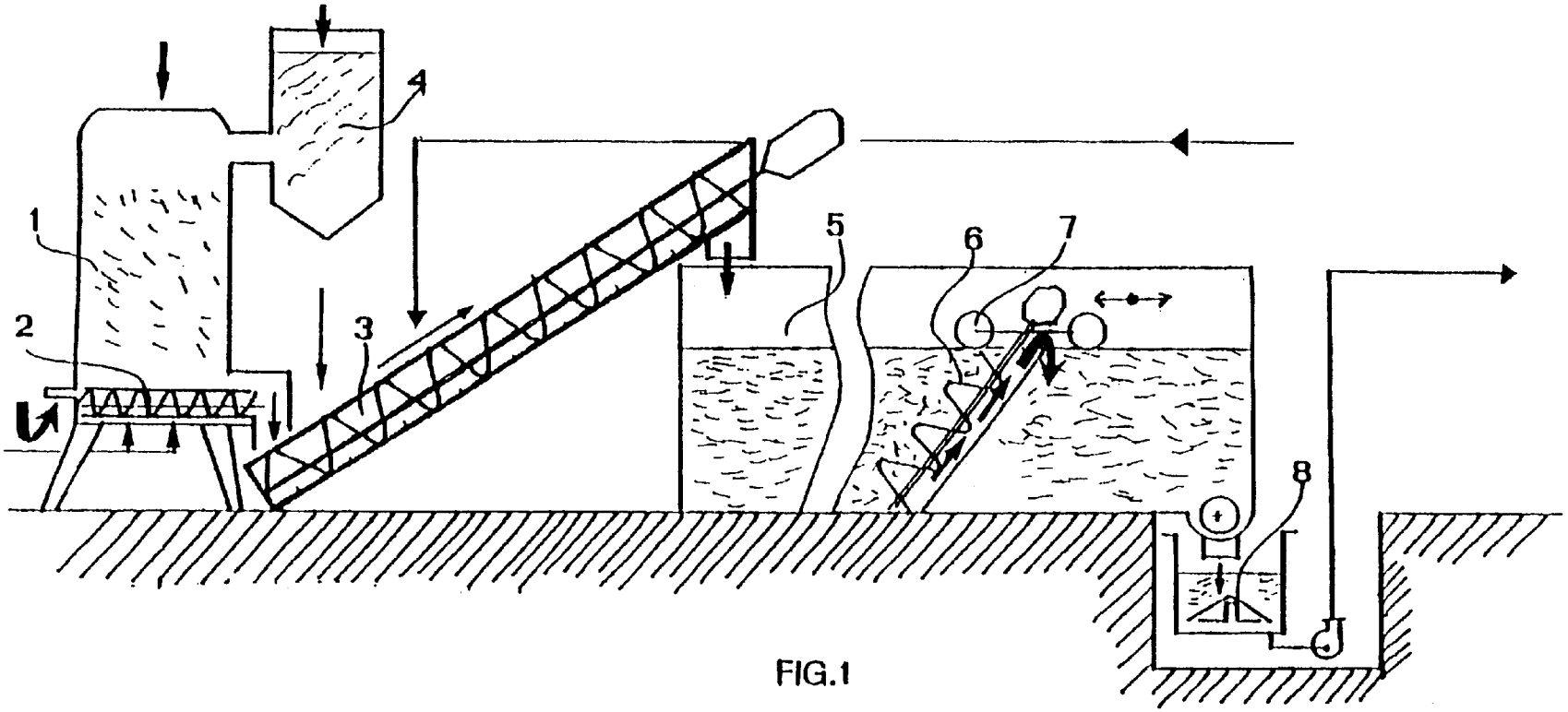
FIG. 1 shows schematically the enzyme production cycle.

Referring now in detail to the drawings and, in particular, FIG. 1 shows the preparation of the enzyme mix sterilization at a temperature higher than of 120° C. of the biomass which will form the culture medium. Sterilisation, according to the present invention, is carried out in the dry phase by means of injections of middle pressure (100–150 kPa) vapour overheated at 200–300° C., at the bottom of a continuous-working cylindrical tower 1. The vegetation to be sterilised is fed in the upper part of tower 1 and extracted at the base after an average permanence of about 20–60 minutes at the chosen temperature; extraction is through a system of mobile screws 2 (of the living bottom bin type) or another system allowing its dosage at the following working station. The dosed material falls into a mixing and transport tilting screw 3 at whose base the inoculum is added as well as a quantity of hot and sterile water from tank 4, sufficient to bring the vegetative mass to the desired concentration and temperature; large diameter screw 3, having a very contained angular velocity, transports the material to the reaction chamber 5, where, in an atmosphere of $CO_2$, $O_2$,controlled pH and temperature, the production of the enzyme takes place. From the moment of the inlet in the sterilisation tower 1 to the end of the reaction chamber 5, the plant is air-tight and the vegetative material is kept out of the contact with the air, to prevent possible infections, etc.

The handling of the biomass in the reaction chamber is performed by a set of tilting axis screws 6 which perform the functions of mixing and handling the fermenting vegetation bed, transporting the biomass from inlet to outlet of the reaction chamber, insertion into the reaction mass of instruments suitable to measure the conditions of temperature, pH, etc. of thermostating (heating, cooling) of the fermenting mass, injection of possible pH corrective solutions, or anyhow solutions useful for the process.

To carry out all these operations, the set of screws is mounted on trolley 7 of a bridge crane that allows its traverse according to the two axes of the reaction chamber; the feed of the material is regulated by the traverse modulable speed of trolley 7 and by the tilt of the axis of screws 6 (0 to 45 degrees), while stirring up is regulated by the rotation modulable speed of the same screws.

The permanence time in the reaction chamber 5 is from 24 to 240 hours and at the end of the period established the vegetation, as a consequence of the effect of the traverse movement performed by the screws, has reached the outlet of the reaction chamber from where it is sent on to a hydraulic pulper 8 which elementarises and soaks it up with the enzyme extraction fluid, generally water.

Such suspension undergoes a double pressing and backwashing which extracts the enzyme almost completely; the enzyme is sent on directly, according to a continuous method, to the treatment of the vegetation to be transformed into paper pulp, while the exhausted material resulting from the pressing gets out of the biological cycle and may be utilised to produce compost or the like.

Figure 2:
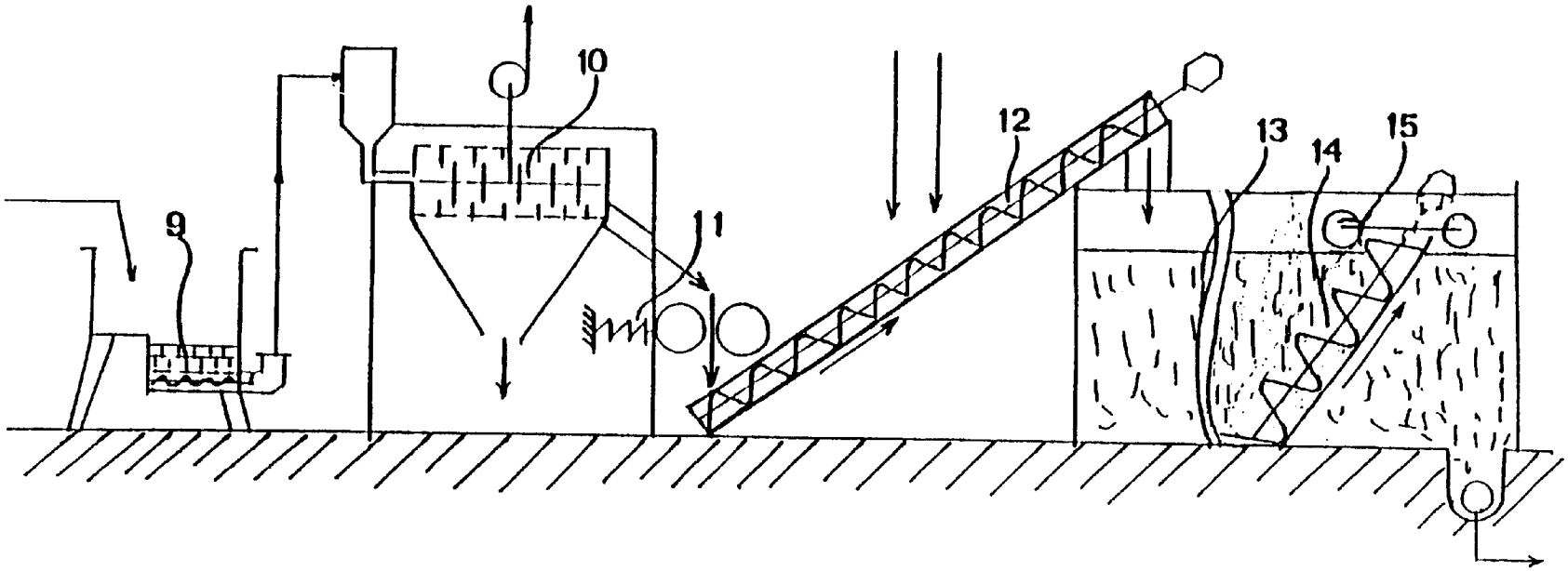
FIG. 2 shows, always schematically, the biological treatment cycle.

The biodelignification process is shown in FIG. 2.

The vegetative material utilised for the production of cellulose pulps is elementarised in a hammer mill 9 continuously fed by a rotary hopper; the treatment of hammer mill 9 has also the function of breaking the possible knots of stems and pulverising leaves, twigs still attached to the vegetation, pith, and removing bast from wood of textile plants, making possible the subsequent separation.

It follows a pneumatic transport which feeds a rotating tumbler 10 provided with reels and counter reels which has the function of removing the undesirable parts and of separating bast from wood.

The clean and possibly selected vegetation is fed to a rotor-compactor 11 whose function is to stably reduce the volume of the vegetation mass and to eliminate a great part of the air contained therein. This material is fed to a mixing and transport tilting screw 12, where the suspension of the enzyme obtained and possibly hot water are added, so as to bring the concentration of the vegetation mass to a percent of 15 to 40.

In such process the compacted vegetation masses keep the form memory, quickly and easily absorb the enzyme mix, which, acting in rapid and a capillary way, increases time and quantity efficiency of biodelignification.

The screw transports the material into a reaction chamber 13 having a controlled atmosphere, quite similar to the production of the enzyme and provided with a set of adjustable axis screws 14 mounted on trolley 15; the biological treatment has a duration between 6 and 24 hours.

Preferably, the coils of the screws are hollow with internal circulation of thermostated fluids; the metal structure of screws 14 may carry the various sensors of the control instruments and homogeneously distribute in the reaction mass fluids for pH correction or anyhow useful for the good outcome of the reaction.

At the end of the biological stage, the material is extracted and passed on to a multi-stage backwashing plant; the washing fluid contains all the soluble substances that were contained at the start in the vegetation and also those that have been solubilised by the biological attack; its BOD and COD content is about 4000–6000 ppm and, given the partial degradation of the dissolved organic molecules, its purification is usually possible by a simple chemical-physical treatment followed by a suitable biological treatment.

Washed pulps have a content of residual modified lignin of about 6–10% in the case of bast of textile plants, and the possible subsequent cooking treatments may be less aggressive than those generally used for the same pulps not biologicalally treated (generally, to arrive at the complete elementarisation of fibres, a mild alkaline treatment in an oxidising environment suffices).

Pulp production operations have been carried out, using the same vegetative material, without and with prior biological treatment, to be in condition of compare and quantify advantages and benefits brought about by the technology subject matter of the present invention.

The characteristics of biotreated pulps referred to not biotreated pulps with comparable dripping show that:

- the percent of reagent and the mechanical energy necessary to arrive at a given dripping of fibres is always lower for the biotreated material, which means that, during the biological treatment the lignin fraction undergoes a deep disgregating action. In the case of kenaf bast, it was even possible to obtain the elementarisation of fibres without any chemical help and the mechanical energy used resulted to be less than half the one necessary in conventional treatments;
- the process total yields are markedly higher for pulps obtained with a prior biotreatment.

This, besides being an important economic factor, confirms the great selectivity and efficaciousness of the biological attack.

The process subject matter of the present invention is suitable for the treatment of traditional raw materials (arboreal species) as well as of especially cultivated annual plants (textile plants with special reference to kenaf), and of waste biomasses (cereal straws, maize stalks, etc.). Through the setting up and mutual harmonisation of the biological, biochemical and technological components with more than positive results, this process allows:

- optimisation of mycelium growth processes,
- attack selectivity on lignocellulose polymers,
- reproducibility of results,
- biodegradation efficiency
- velocity of biological processes fully in keeping with industrial times,
- possibility of continuous operation with fully automated plants and cycles,
- absence of toxic compounds of fungus-origin.

Concerning the process aspect, several steps have been set up consisting of the following main points:

- mechanical pre-treatment of stems of annual plants (cotton, flax, Graminae straws, stalks, kenaf, etc.), to separate bast from xylem, without compromising the fibre length,
- loading of the vegetation in the inside of a rotary or continuous bioreactor,
- addition of a hexocellular enzym cocktail to lignecellulose material,
- mix incubation at variable temperatures and for a variable period of time,
- washing of the material biotreated for the production of cellulose pulp and the fabrication of paper, utilising a thermomechanical treatment.

In the following, some examples are given of production of cellulose pulps obtained from annual plants and in particular kenaf bast and wood and agricultural residues (wheat straw and maize stalks).

According to the present invention, all the operations concerning the production of the enzyme are carried out according to a continuous method and therefore the running of the enzyme production plant can be fully automated with extreme easiness. At the same time, the storing time and quantity—which would need particular cares especially as concerns preservation temperature—is reduced to a minimum.

The biological treatment with enzymes of the vegetation to be transformed into cellulose pulp, besides being modulable and selective with regard to lignins and/or hemicelluloses takes place at very contained temperatures and therefore in conditions that cause the possible polycondensations of the lignin macromolecules that hinder the subsequent operations of transformation into pulp and of bleaching to be extremely limited.

The biological attack of the material to be used for the production of cellulose takes place in reaction chambers like those used for the production of the enzyme according to a likewise continuous and relatively quick process, easily adjustable and automatically controllable for all the mass being worked.

It is also worth stressing that the prior biological treatment allows to utilise, in the subsequent transformation into pulp, mild treatments (mechanical, thermal, chemical), with ensuing remarkable saving of mechanical and thermal energy and of chemical reagents; also the global costs of industrial installation and the running costs are much reduced compared to those of conventional plants. Besides, as the biological activity is extremely selective, the yields of pulp production obtainable through the biological treatment are—on the average—higher with respect to conventional yields, and the selectivity of biological attack involes a lower hydrolysis of cellulose chains with ensuing improvement of all the mechanical characteristics of the pulps produced and especially of the tearing index that is the most required characteristic for almost all the types of paper.

In keeping with the greater global yield of transformation into pulps and the reduced use of reagents, the content of organic and inorganic substances of refluents is markedly reduced, which causes the purification of the same to be less expensive.

For particular vegetation (such as the bast of kenaf and other textile plants), for whose transformation into paper pulps the biological treatment alone followed by an appropriate mechanical treatment may suffice, the industrial plant and its running may be particularly simple and inexpensive; also the treatment of refluents might be limited to a simple chemical-physical treatment followed by a particularly accurate biological treatment.

The whole without adversely affecting in any way the physical-mechanical and optical qualities of the producible pulps. Besides, the simplicity of the biological-mechanical treatment alone, and the contained cost of the plants for the transformation into paper pulp that can be used for some particular types of vegetation allow the running of small size plants like those that might be installed in countries that do not have large areas to be allocated for paper production.

EXAMPLE 1

Kenaf bast, suitably chopped up in such a way as not to jeopardise fibre length, was treated with an enzyme mix obtained by growing the mushroom Lentinus edodes in liquid medium.

Such mix was added to the solid medium, adopting the 5:1 volume/weight ratio, and the whole was allowed to incubate at 40° C. for 24 hours in a fermenter. The mix was characterised by the presence of enzyme activities involved in the degradation of the polymers of the vegetable wall, except for cellulases, that may play an unwished role in such applications. At the end of the incubation, the material was pressed and submitted to the thermomechanical process.

Such pre-treatment of a semi-industrial type (400 kg/h) consistently reduces pulp dripping, which is an important parameter in paper industry, as it is an indirect measure of water retention by the same pulp. As a consequence a reduction in the same positively affects paper production time. Pulp yield did not undergo significant reduction compared to control. Another consequence of biotreatment was an increase in some properties of strength of the obtained layer compared to untreated control, in particular the values of ultimate length and burst index were higher than the control by 36 and 45% respectively. Besides, using a peroxide bleach, a degree of whiteness was obtained that was greatly improved with respect to control.

TABLE 1

| | biotreated | control |
|---|---|---|
| dripping | 25 | 45 |
| density | 0.38 | 0.56 |
| traction index | 34.0 | 25.0 |
| tearing index | 6.2 | 4.1 |
| burst index | 2.8 | 1.5 |
| IRB (degree of whiteness) | 75 | 65 |

EXAMPLE 2

In this case, an enzyme preparation was used that had been obtained by hydraulically pressing the lignocellulose material (wheat straw) colonised by the Lentinus edodes mushroom. This preparation contained an activity spectrum wider than that of the preparation obtained from fluid culture of the same mushroom, and was characterised by the presence of celluloselythic enzymes and a higher manganese-dependent and hemicellulosic peroxidase activity, with respect to the extract utilised in Example 1. Kenaf bast was treated in the same conditions of Example 1, except for the treatment time which was halved (12 hours). Such reduction, allowed by a greater volumetric activity of the individual enzymes contained in the mix (in particular laccase, tyrosinase, Mn-peroxidase and endoxylanase, esterase, oxygenase, etc.) prevents effects due to the presence of celluloselythic activities that could jeopardise the integrity of the fibres. The chemical quantitative analysis of wall polymers of biologically treated samples compared to control, showed a reduction in lignin content of about 10–12% and a marked reduction of the hemicellulose fraction, while cellulose appeared to be unaltered. Also in this case, a substantial reduction in dripping was noticed (−32%) as well as an increase with respect to controls in the ultimate length (+42–45%) and the burst index (50–55%). (Table 2).

TABLE 2

| | biotreated | control |
|---|---|---|
| dripping | 28 | 37 |
| density | 0.42 | 0.60 |
| traction index | 41 | 28 |
| tearing index | 5.8 | 3.9 |
| burst index | 2.8 | 1.8 |
| IRB (degree of whiteness) | 77 | 62 |

EXAMPLE 3

An enzyme preparation obtained by growing for seven days the mushroom Pleurotus eryngii according to the submerged cultivation method was utilised to treat maize stalks. The preparation was added to the material to be treated according to a 1:6 weight/volume ratio, and the whole was allowed to incubate for 24 hours at 50×C. The analysis of the fibrous composition of the material showed that the cellulose and hemicellulose contents were unchanged with respect to the control, while lignin content was reduced by 10%. Such material was submitted to the thermomechanical process. The pulp yield was not significantly reduced, while its dripping was markedly reduced (−35%) compared to control.

Burst index appeared to have improved with respect to control (+30%) as well as ultimate length. (Table 3).

TABLE 3

| | biotreated | control |
|---|---|---|
| dripping | 27 | 37 |
| density | 0.45 | 0.52 |
| traction index | 35 | 27 |
| tearing index | 4.5 | 3.2 |
| burst index | 2.9 | 2.2 |
| IRB (degree of whiteness) | 62 | 48 |

EXAMPLE 4

The repetition of the biotreatment described for Example 3 with the same extract diluted 10 times in water allowed to obtain results comparable to those of the preceding example, suggesting the possibility of reducing the concentration of biocatalysts in such process. (Table 4).

TABLE 4

| | biotreated | control |
|---|---|---|
| dripping | 25 | 42 |
| density | 0.42 | 0.66 |
| traction index | 39 | 28 |
| tearing index | 5.2 | 2.8 |
| burst index | 3.0 | 2.3 |
| IRB (degree of whiteness) | 65 | 51 |

Accordingly, while only a few embodiments of the present invention have been shown and described, it is obvious that many changes and modifications may be made thereunto without departing from the spirit and scope of the invention.

What is claimed is:

1. A process for the production of cellulose paper pulps from vegetative masses, comprising the following steps:

sterilizing and dosing a mass suitable to form a culture medium at a temperature of at least 120° C.;

mixing said sterilized and dosed mass with a dosed inoculum and heated sterile water, in such a quantity to achieve a desired temperature and concentration of said mass;

conditioning and reacting by stirring said inoculated mass in a controlled atmosphere of $CO_2$ and $O_2$ and a sterile environment having a controlled temperature and pH for 20 to 300 hours, for producing suitable enzyme mixes;

elementizing said mass containing said enzymes and soaking up the same with an extraction fluid to form a suspension;

extracting said enzymes in said extraction fluid by pressing and backwashing said suspension for obtaining an enzyme extract, and separating an extracted solid resulting from said pressing;

elementizing, separating, cleaning and selecting a vegetative material for the production of said cellulose paper pulp for obtaining a useful vegetative mass and waste material;

compacting said useful vegetative mass for eliminating air and reducing its volume;

mixing said compacted mass with said enzyme extracts in a dosed quantity and with heated water for obtaining a vegetative mass having a solid mass content between 10 and 50% by weight;

conditioning and reacting said vegetative mass mixed with said enzymes by stirring in a controlled atmosphere of $CO_2$ and $O_2$ and at a controlled temperature and pH for 5 to 50 hours and washing with water to obtain a washed cellulose paper pulp with a low content of residual modified lignin and a washing fluid containing soluble substances that were originally contained in said vegetative material together with the soluble substances;

cooking and bleaching said washed cellulose pulp; and purifying and disposing of said washing fluid.

2. The process according to claim 1, wherein said vegetative material comprises cultivated annual plants selected from the group consisting of kenaf, hemp, flax and cotton.

3. The process according to claim 1, wherein said inoculum comprises edible ligninolythic mushrooms selected from the group consisting of *Lentinus edodes, Pleurotus eryngii, Pleurotus sajor-caju.*

4. The process according to claim 1, wherein said sterilizing step occurs in a dry phase through injection of a medium pressure vapor of 100–150 kPa, overheated at 200–300° C., for 20–60 min.

5. The process according to claim 1, wherein said mass suitable to form said culture medium comprises vegetable waste material.

6. The process according to claim 1, wherein said elementizing of said mass containing said enzyme mixes is accomplished by a mechanical-hydraulic action in water.

7. The process according to claim 1, wherein the process steps of obtaining said enzyme extract and obtaining said washed cellulose paper pulps are continuous and automated.

8. The process according to claim 1, wherein the process occurs at a low temperature for reducing polycondensation of lignin macromolecules that hinder the cooking and bleaching of said washed cellulose pulp.

* * * * *